US008320788B2

(12) United States Patent
Saeki

(10) Patent No.: US 8,320,788 B2
(45) Date of Patent: Nov. 27, 2012

(54) IMAGE FORMING APPARATUS, RETURN PROCESSING METHOD, AND PROGRAM

(75) Inventor: Iwao Saeki, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 362 days.

(21) Appl. No.: 12/795,118

(22) Filed: Jun. 7, 2010

(65) Prior Publication Data

US 2010/0316405 A1 Dec. 16, 2010

(30) Foreign Application Priority Data

Jun. 15, 2009 (JP) ..... 2009-142702
Apr. 28, 2010 (JP) ..... 2010-104356

(51) Int. Cl.
*G03G 15/00* (2006.01)
*G03G 21/00* (2006.01)

(52) U.S. Cl. ..... 399/88; 399/75

(58) Field of Classification Search ..... 399/75, 399/76, 77, 88
See application file for complete search history.

(56) References Cited

U.S. PATENT DOCUMENTS 6,226,472 B1 * 5/2001 Yun ..... 399/88 X
7,076,673 B2 * 7/2006 Yoshikawa ..... 399/88 X
7,428,391 B2 * 9/2008 Kobayashi ..... 399/88
2007/0247467 A1 * 10/2007 Kaneda ..... 399/88 X
2008/0260416 A1 * 10/2008 Nosaki ..... 399/88

FOREIGN PATENT DOCUMENTS

JP 3428590 5/2003
JP 2007-159298 6/2007
JP 2008-72391 3/2008

* cited by examiner

*Primary Examiner* — Sandra Brase
(74) *Attorney, Agent, or Firm* — Oblon, Spivak, McClelland, Maier & Neustadt, L.L.P.

(57) ABSTRACT

An image forming apparatus, which has a plurality of operation modes with different power supply conditions, includes an electric-energy accumulating unit for calculating electric energy consumption in a current operation mode; a return-time calculating unit for calculating a return time taken for the image forming apparatus to return from an energy reduction mode, which is the operation mode in which part of the image forming apparatus is supplied with electric power, to a normal mode, which is the operation mode in which the whole image forming apparatus is supplied with electric power, on the basis of the calculated electric energy consumption and an upper limit of electric energy, which is predetermined as maximum electric energy consumption in a certain period of time; and a mode control unit for making the image forming apparatus return from the energy reduction mode to the normal mode on the basis of the calculated return time.

18 Claims, 13 Drawing Sheets

FIG. 4A

311

| MODE | NORMAL MODE | STANDBY MODE | ENERGY-SAVING MODE | LOW-POWER MODE |
|---|---|---|---|---|
| REFERENCE ELECTRIC ENERGY CONSUMPTION | 1000 Wh | 500 Wh | 300 Wh | 100 Wh |

REFERENCE ELECTRIC ENERGY CONSUMPTION TABLE

FIG. 4B

312

| MODE | NORMAL MODE | STANDBY MODE | ENERGY-SAVING MODE | LOW-POWER MODE |
|---|---|---|---|---|
| POSSIBLE RETURN TIME | 0 sec. | 20 sec. | 30 sec. | 40 sec. |

POSSIBLE RETURN TIME TABLE

811

| REFERENCE-VALUE RATIO | 100% - 60% | 59% - 40% | 39% - 20% | 19% - 0% |
|---|---|---|---|---|
| RETURN TIME | 60 sec. | 40 sec. | 30 sec. | 20 sec. |

EXAMPLE 1 OF RETURN TIME TABLE

FIG. 11

811

| REMAINING ELECTRIC ENERGY | 30000 Wh | 20000 Wh | 10000 Wh | 5000 Wh |
|---|---|---|---|---|
| RETURN TIME | 20 sec. | 30 sec. | 40 sec. | 60 sec. |

EXAMPLE 2 OF RETURN TIME TABLE

FIG. 12

811

DAY 1 TO DAY 10

| REMAINING ELECTRIC ENERGY | 30000 Wh | 20000 Wh | 10000 Wh | 5000 Wh |
|---|---|---|---|---|
| RETURN TIME | 60 sec. | 90 sec. | 180 sec. | 360 sec. |

DAY 11 TO DAY 20

| REMAINING ELECTRIC ENERGY | 30000 Wh | 20000 Wh | 10000 Wh | 5000 Wh |
|---|---|---|---|---|
| RETURN TIME | 40 sec. | 60 sec. | 80 sec. | 120 sec. |

DAY 21 TO DAY 30

| REMAINING ELECTRIC ENERGY | 30000 Wh | 20000 Wh | 10000 Wh | 5000 Wh |
|---|---|---|---|---|
| RETURN TIME | 20 sec. | 30 sec. | 40 sec. | 60 sec. |

TERM-SPECIFIC RETURN TIME TABLE

T6

| RETURN TIME | 20 sec. | 30 sec. | 40 sec. | 60 sec. |
|---|---|---|---|---|
| MESSAGE | ENOUGH ENERGY LEFT | ENERGY LEFT | CAUTION -- LITTLE ENERGY LEFT | VERY LITTLE ENERGY LEFT |

MESSAGE TABLE

IMAGE FORMING APPARATUS, RETURN PROCESSING METHOD, AND PROGRAM

CROSS-REFERENCE TO RELATED APPLICATIONS

The present application claims priority to and incorporates by reference the entire contents of Japanese Patent Application No. 2009-142702 filed in Japan on Jun. 15, 2009 and Japanese Patent Application No. 2010-104356 filed in Japan on Apr. 28, 2010.

BACKGROUND OF THE INVENTION

1. Field of the Invention

The present invention relates to an image forming apparatus, a return processing method, and a program.

2. Description of the Related Art

In recent years, as measures for environmental protection, energy conservation measures have been taken in the various fields. Even the field of an image forming apparatus, such as a copier and a printer, is no exception, and various kinds of efforts for energy conservation have been made in the design of the image forming apparatus.

For example, as a typical way to reduce power consumption, after a certain period of time has elapsed since a copier has not been in operation, the operation mode is switched to an energy-saving mode in which part of the copier that consumes relatively high power, such as an engine unit, is powered off, and after a certain additional period of time has elapsed, a controller unit goes into a sleep mode, and the operation state of the copier is switched to the one in a low-power mode.

As an energy conservation measure that comes from a different mindset, there has been proposed a power consumption limiting system that divides users into groups, accumulates electric energy consumed for execution of jobs in each group on a group-by-group basis, and limits execution of a job in a group of which the accumulated total electric energy exceeds an upper limit of electric energy assigned to the group (see Japanese Patent No. 3428590).

Furthermore, as another energy conservation measure, there has been proposed a "power monitoring network system" that estimates the month's electric energy consumption of an image forming apparatus on the basis of history information, and determines whether the estimated electric energy consumption exceeds available maximum electric energy set in advance (see Japanese Patent Application Laid-open No. 2007-159298).

In this power monitoring network system, if the estimated electric energy consumption exceeds the maximum electric energy, a power management device preliminarily performs a simulation process for calculating electric energy consumption that can be reduced by changing the setting of use conditions of the apparatus on the basis a power reduction level set according to the excess electric energy consumption. By performing the simulation process, appropriate use conditions capable of preventing electric energy consumption from exceeding the maximum electric energy are determined.

Moreover, as still another energy conservation measure, there has been proposed a method for optimizing the time to make the transition to an energy-saving mode by storing the state transition to a standby mode or the energy-saving mode and learning the use frequency and content (see Japanese Patent Application Laid-open No. 2008-072391).

In the power consumption limiting system disclosed in Japanese Patent No. 3428590, it can be expected that users belonging to each group are more conscious of saving on electricity and make efforts for it, which leads to the promotion of energy conservation; however, a limitation on the use is placed only if electric energy consumption exceeds the upper limit, which means no limitation is placed until electric energy consumption exceeds the upper limit.

Furthermore, the power monitoring network system disclosed in Japanese Patent Application Laid-open No. 2007-159298 is aimed at improving the accuracy of calculation of future electric energy consumption, and any means to limit electric energy consumption is not particularly described in Japanese Patent Application Laid-open No. 2007-159298.

Moreover, with a method for setting a transition period disclosed in Japanese Patent Application Laid-open No. 2008-072391, the transition time can be optimized and energy conservation can be improved without bothering a user with a troublesome operation (settings of the times to make the transition to multiple energy-saving modes, etc.). However, this method is aimed at determining a transition pattern, and as a means to limit electric energy consumption, the start time (the return time) is not subject to the energy conservation measure.

In considering an energy conservation measure in an MFP (Multi Function Peripheral) or an LP (Laser Printer) (hereinafter, referred to as simply "the apparatus"), conventionally, energy conservation is achieved by switching the mode, for example, to an energy-saving mode; however, even in a case of restraining total electric energy consumption, as described in Japanese Patent No. 3428590, electric energy consumption is restrained after it exceeds an upper limit, and no energy conservation measure is taken unless the electric energy consumption exceeds the upper limit.

In the apparatus, together with the energy conservation measure described above, various measures to improve the operating rate, i.e., improve the productivity are implemented.

For example, reduction of the time to return from a standby state in which the apparatus is in an energy-saving mode to a ready state in which the apparatus is ready for operation is performed. This is because the shorter the return time is, the higher the productivity, resulting in an increase in the operating rate. Namely, for example, if a job that takes 3 minutes is repeated with the standby time of 1 minute and the return time of 10 seconds, 14.4 jobs can be executed in an hour. If the return time is 1 minute, 12 jobs can be executed in an hour, which means a difference of about 2 jobs and a difference of about 6 minutes in the operating time are made.

Furthermore, to reduce the return time of the apparatus, even when the apparatus is not in operation, for example, the apparatus is in a standby mode or the energy-saving mode, residual heat is always applied to a fixing unit of an engine unit.

Moreover, as the size of software of a controller is enlarged today, it takes time to load an object and initialize it, and the return time of the apparatus tends to be prolonged; therefore, the controller is powered on with the software be resident in a memory, thereby reducing the return time.

In this manner, currently, some power consumption is sacrificed to improve the operating rate of the apparatus while trying to conserve energy of the apparatus.

Consequently, there has been expected energy conservation measures capable of achieving energy conservation while maintaining the operating rate of the apparatus appropriately, i.e., energy conservation measures balanced for both the operating rate of the apparatus and energy conservation.

SUMMARY OF THE INVENTION

It is an object of the present invention to at least partially solve the problems in the conventional technology.

According to an aspect of the present invention there is provided an image forming apparatus having a plurality of operation modes with different power supply conditions. The image forming apparatus includes: an electric-energy accumulating unit that calculates electric energy consumption in a current operation mode; a return-time calculating unit that calculates a return time taken for the image forming apparatus to return from an energy reduction mode, which is the operation mode in which part of the image forming apparatus is supplied with electric power, to a normal mode, which is the operation mode in which the whole image forming apparatus is supplied with electric power, on the basis of the calculated electric energy consumption and an upper limit of electric energy, which is predetermined as maximum electric energy consumption in a certain period of time; and a mode control unit that makes the image forming apparatus return from the energy reduction mode to the normal mode on the basis of the calculated return time.

According to another aspect of the present invention there is provided a return processing method implemented by an image forming apparatus having a plurality of operation modes with different power supply conditions. The return processing method includes: calculating electric energy consumption in a current operation mode; calculating a return time taken for the image forming apparatus to return from an energy reduction mode, which is the operation mode in which part of the image forming apparatus is supplied with electric power, to a normal mode, which is the operation mode in which the whole image forming apparatus is supplied with electric power, on the basis of the calculated electric energy consumption and an upper limit of electric energy, which is predetermined as maximum electric energy consumption in a certain period of time; and making the image forming apparatus return from the energy reduction mode to the normal mode on the basis of the calculated return time.

According to still another aspect of the present invention there is provided a computer program product comprising a computer-usable medium having computer-readable program codes. The program codes when executed causing a computer in an image forming apparatus having a plurality of operation modes with different power supply conditions to execute: calculating electric energy consumption in a current operation mode; calculating a return time taken for the image forming apparatus to return from an energy reduction mode, which is the operation mode in which part of the image forming apparatus is supplied with electric power, to a normal mode, which is the operation mode in which the whole image forming apparatus is supplied with electric power, on the basis of the calculated electric energy consumption and an upper limit of electric energy, which is predetermined as maximum electric energy consumption in a certain period of time; and making the image forming apparatus return from the energy reduction mode to the normal mode on the basis of the calculated return time.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 4A is an explanatory diagram showing an example of a reference electric energy consumption table according to the first embodiment;

FIG. 4B is an explanatory diagram showing an example of a possible return time table according to the first embodiment;

FIG. 11 is an explanatory diagram showing another example of the return time table according to the second embodiment;

FIG. 12 is an explanatory diagram showing an example of a term-specific return time table provided for each term;

DETAILED DESCRIPTION OF THE PREFERRED EMBODIMENTS

Exemplary embodiments of an image forming apparatus, a return processing method, and a program according to the present invention are explained in detail below with reference to the accompanying drawings.

First Embodiment

An image forming apparatus according to a first embodiment is a digital multifunction peripheral (hereinafter, referred to as an "MFP") having copy, fax, print, and scan functions and a function of delivering an input image (an image of an original read through the scan function or an image input through the print function or the fax function), etc.

Figure 1:
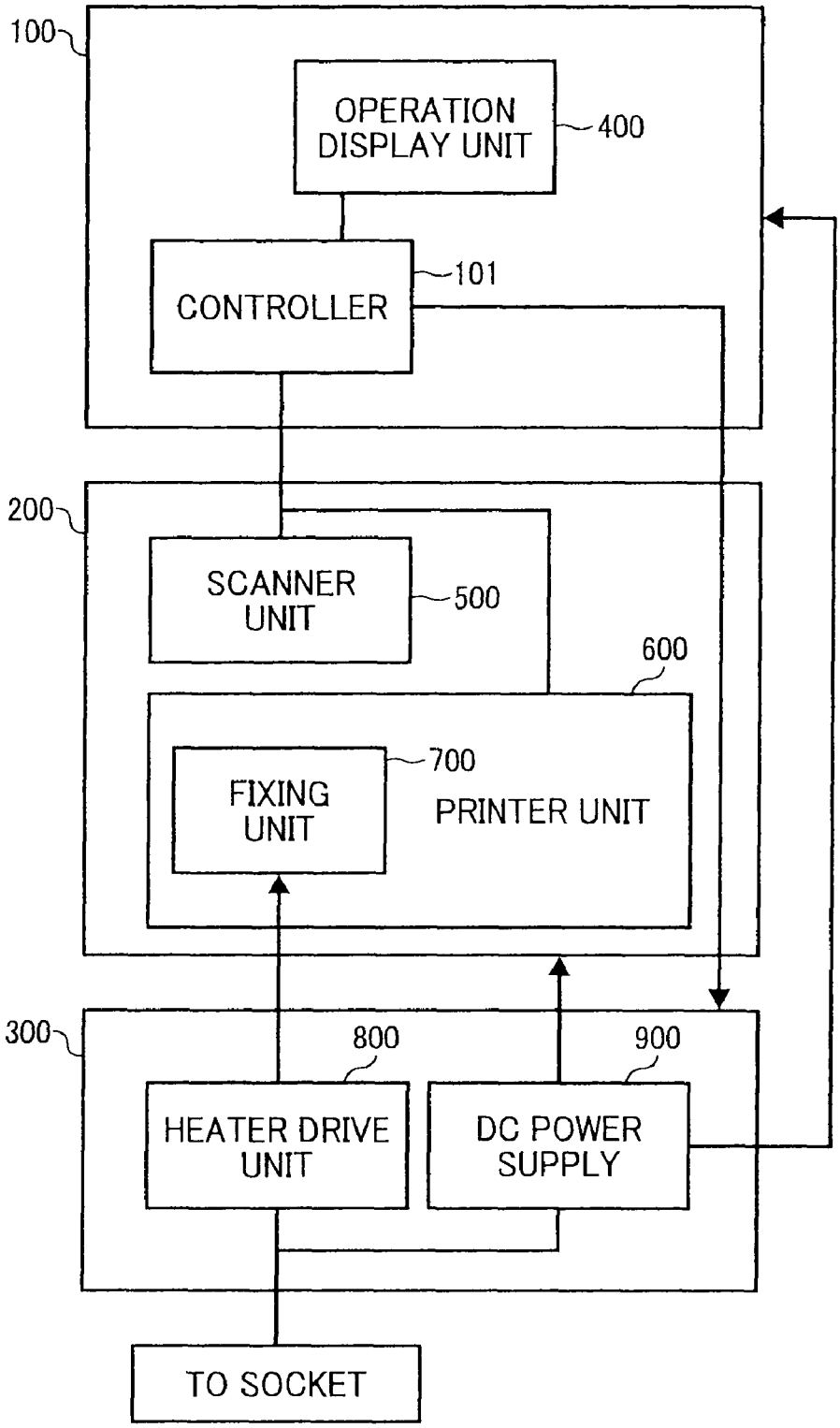
FIG. 1 is a schematic configuration diagram of a digital multifunction peripheral (MFP) according to a first embodiment.

FIG. 1 is a schematic configuration diagram of the MFP according to the first embodiment. As shown in FIG. 1, in the MFP, a system management unit 100, including controller loads such as a controller 101 and an operation display unit 400, and an engine unit 200, including engine loads such as a scanner unit 500 and a printer unit 600, are each supplied with electric power from a power supply unit 300. The power supply unit 300 is composed of a direct-current (DC) power supply 900 and a heater drive unit 800. The DC power supply 900 supplies electric power to the system management unit 100 and the engine unit 200. The heater drive unit 800 supplies electric power to a fixing unit 700 of the printer unit 600.

In the present embodiment, to make the MFP operate in an energy reduction mode, the system management unit 100 controls the engine unit 200 and the power supply unit 300.

The operation display unit 400 includes a liquid crystal panel and an operation unit. Various kinds of screens are displayed on the liquid crystal panel, and a user makes various operation instructions by a touch input on the screen displayed on the liquid crystal panel. The operation unit includes various buttons to be held down by the user.

The system management unit 100 controls the engine unit 200 and the power supply unit 300, thereby making the MFP operate in the energy reduction mode (an energy-saving mode). Namely, the system management unit 100 accumulates electric energy consumption based on the operation mode and the operating time, calculates a return time based on the accumulated electric energy consumption and a preset upper limit of electric energy, and controls the engine unit 200 and the power supply unit 300.

Figure 2:
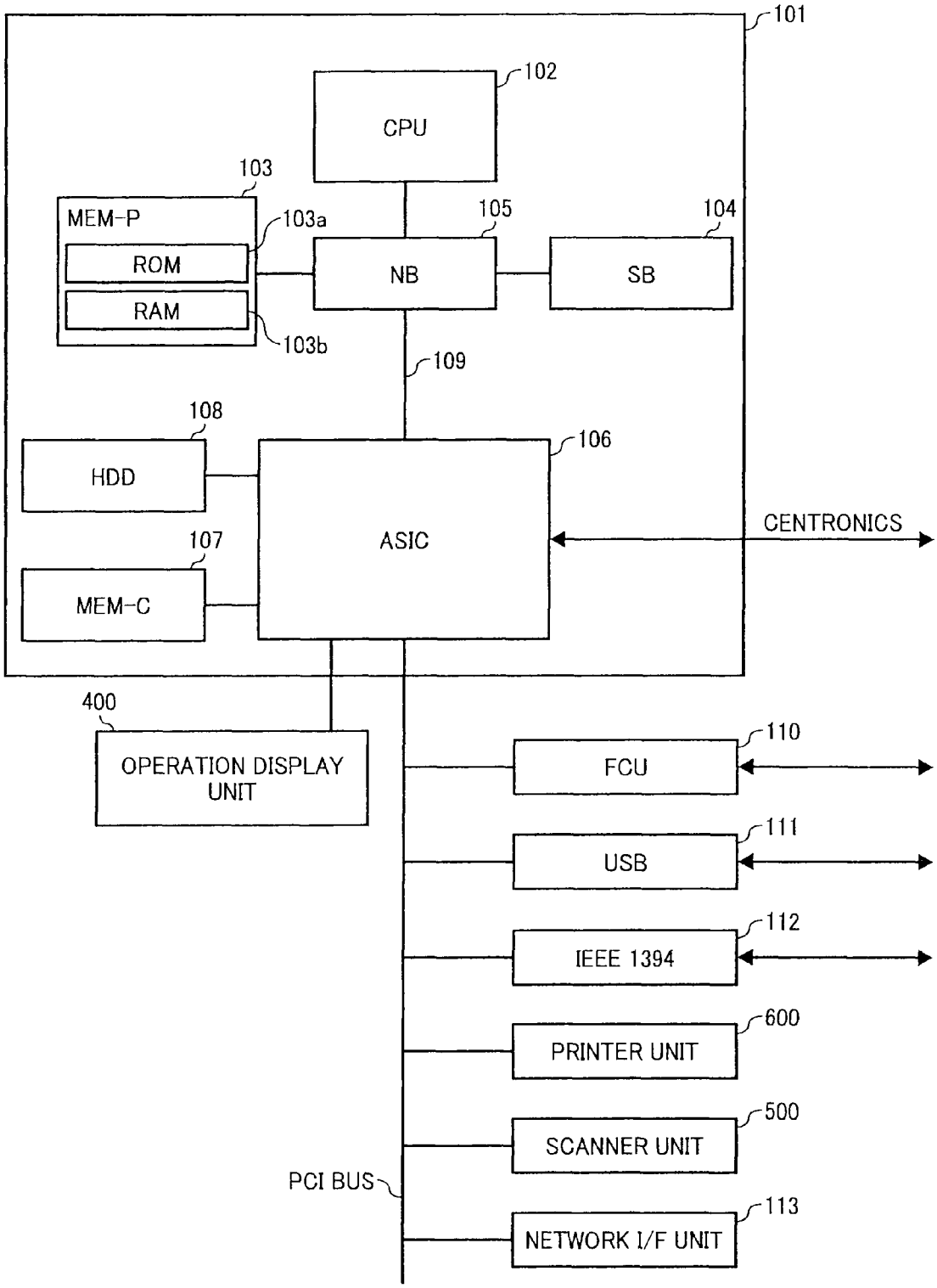
FIG. 2 is a block diagram illustrating a configuration of a control circuit of a system management unit according to the first embodiment.

FIG. 2 is a block diagram illustrating a configuration of a control circuit of the system management unit 100 according to the first embodiment. As shown in FIG. 2, the MFP has a configuration that the controller 101, which controls the entire MFP, drawing, communication, and an input from the operation display unit, is connected to the printer unit 600 and the scanner unit 500 by a PCI (Peripheral Component Interconnect) bus.

The controller 101 includes a central processing unit (CPU) 102 which is a main part of a computer, a system memory (MEM-P) 103, a Northbridge (NB) 105, a Southbridge (SB) 104, an application specific integrated circuit (ASIC) 106, a local memory (MEM-C) 107, and a hard disk drive (HDD) 108. The NB 105 and the ASIC 106 are connected by an AGP (Accelerated Graphics Port) bus 109. The MEM-P 103 includes a read-only memory (ROM) 103*a* and a random access memory (RAM) 103*b*.

The CPU 102 controls the entire MFP; the CPU 102 has a chipset composed of the NB 105, the MEM-P 103, and the SB 104, and is connected to other devices via the chipset.

The NB 105 is a bridge connecting between the CPU 102 and the MEM-P 103, the SB 104, and the AGP bus 109, and includes, although not shown in the drawings, a memory controller for controlling read/write with respect to the MEM-P 103 and the like, a PCI master, and an AGP target.

The MEM-P 103 is a system memory used as a memory for storing a program or data, a memory for decompressing a program or data, a drawing memory of the printer, and the like. The MEM-P 103 is composed of the ROM 103*a* and the RAM 103*b*. The ROM 103*a* is a read-only memory used as a memory for storing a program or data for controlling the operation of the CPU 102. The RAM 103*b* is a writable and readable memory used as a memory for decompressing a program or data, a drawing memory of the printer, and the like.

The SB 104 is a bridge connecting between the NB 105 and the PCI devices and peripheral devices. The SB 104 is connected to the NB 105 via the PCI bus. A network interface (I/F) unit 113 is also connected to the PCI bus.

The ASIC 106 is an integrated circuit (IC) for image processing that includes hardware components for image processing, and serves as a bridge connecting the AGP bus 109, the PCI bus, the HDD 108, and the MEM-C 107. The ASIC 106 is composed of, although not shown in the drawings, a PCI target, an AGP master, an arbiter (ARB) constituting the core of the ASIC 106, a memory controller for controlling the MEM-C 107, a plurality of direct memory access controllers (DMACs) that performs, for example, rotation of image data by a hardware logic or the like, and a PCI unit that performs data transfer with the printer unit 600 or the scanner unit 500 via the PCI bus. A fax control unit (FCU) 110, a Universal Serial Bus (USB) 111, and the Institute of Electrical and Electronics Engineers (IEEE) 1394 interface 112 are connected to the ASIC 106 via the PCI bus.

The MEM-C 107 is a local memory used as a copy image buffer and a code buffer. The HDD 108 is a storage for accumulating image data, a program for controlling the operation of the CPU 102, font data, and forms.

The AGP bus 109 is a bus interface for a graphics accelerator card for accelerating graphics processing, and accelerates the processing in the graphics accelerator card by providing direct access to the MEM-P 103 with high throughput.

Figure 3:
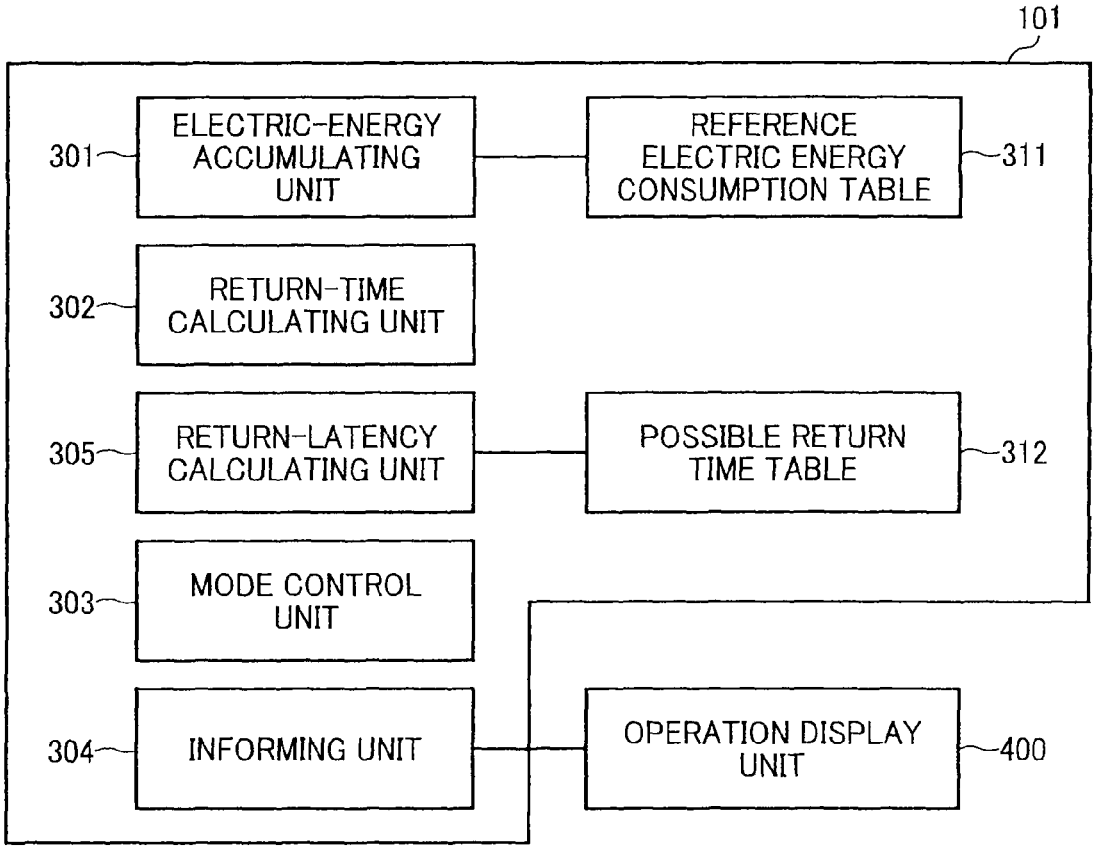
FIG. 3 is a block diagram illustrating a functional configuration of a controller according to the first embodiment.

Subsequently, features of the energy reduction mode for saving electric power when the MFP is put into a standby state by execution of a program by the controller 101 of the MFP according to the present embodiment are explained. The MFP according to the present embodiment operates in any of a plurality of operation modes with different power supply conditions. FIG. 3 is a block diagram illustrating a functional configuration of the controller 101 according to the first embodiment.

As shown in FIG. 3, the controller 101 mainly includes an electric-energy accumulating unit 301, a return-time calculating unit 302, a return-latency calculating unit 305, a mode control unit 303, an informing unit 304, a reference electric energy consumption table 311, and a possible return time table 312.

The mode control unit 303 makes the MFP return from the energy reduction mode to a normal mode after the elapse of a return latency based on a return time to be described below. The normal mode here is the operation mode in which electric power is supplied to the whole MFP thereby making the whole system operate. Furthermore, the energy reduction mode (an energy-saving mode) is the operation mode in which electric power is supplied to part of the MFP.

Namely, in the energy reduction mode implemented when the MFP according to the present embodiment is in the standby state, a fixing heater of the fixing unit 700, the operation display unit 400, and the like which consume high power are powered off or switched in low-power operation, and the scanner unit 500 is entirely powered off. More specifically, the MFP according to the present embodiment has the following three energy reduction modes.

Standby mode: Power supply to part of the engine unit is shut off.

Energy-saving mode: Power supply to the whole engine unit is shut off.

Low-power mode: Power supply to the whole engine unit and part of the controller unit is shut off.

Furthermore, the operation mode in which the whole system is in operation is referred to as the normal mode. Therefore, the operation mode of the image forming apparatus according to the present embodiment includes the normal mode, the standby mode, the energy-saving mode, and the low-power mode. The current operation mode is stored in a storage medium, such as the MEM-C 107 or the HDD 108.

At the transition from the normal mode to the energy reduction mode, the mode control unit 303 determines (sets) any of the standby mode, the energy-saving mode, and the low-power mode as the energy reduction mode to which the transition from the normal mode is made on the basis of the operating time, and causes the MFP to make the transition to the determined energy reduction mode.

The reference electric energy consumption table 311 is a table in which reference electric energy consumption that is electric energy consumption per unit time, in each of the operation modes is registered, and is used for calculation of electric energy consumption. FIG. 4A is an explanatory diagram showing an example of the reference electric energy consumption table 311 according to the first embodiment. As shown in FIG. 4A, in the reference electric energy consumption table 311, reference electric energy consumption in each of the normal mode, the standby mode, the energy-saving mode, and the low-power mode is set in advance. More specifically, the reference electric energy consumption is set to get lower in the order of the normal mode, the standby mode, the energy-saving mode, and the low-power mode.

The possible return time table 312 is a table in which a possible return time, a possible time taken to return from each operation mode to the normal mode, in each of the operation modes is registered, and is used for calculation of a return latency. FIG. 4B is an explanatory diagram showing an example of the possible return time table 312 according to the first embodiment. In the possible return time table 312, as shown in FIG. 4B, a possible return time in each of the normal mode, the standby mode, the energy-saving mode, and the low-power mode is set. More specifically, the possible return time is set to take longer in the order of the normal mode, the standby mode, the energy-saving mode, and the low-power mode.

The reference electric energy consumption table 311 and the possible return time table 312 are stored in a storage medium, such as the MEM-C 107 or the HDD 108.

To return to the explanation of FIG. 3, the electric-energy accumulating unit 301 accumulates electric energy consumption consumed in the current operation mode (before the return). More specifically, the electric-energy accumulating unit 301 reads out the reference electric energy consumption in the current operation mode (before the return) from the reference electric energy consumption table 311, and calculates electric energy consumption by multiplying the read reference electric energy consumption in the current operation mode by the operating time in the current operation mode.

The return-time calculating unit 302 calculates a return time taken to return from the energy reduction mode to the normal mode on the basis of the electric energy consumption calculated by the electric-energy accumulating unit 301, an upper limit of electric energy assigned to a certain period of time, and the reference electric energy consumption. More specifically, as shown in the following equation (1), the return-time calculating unit 302 calculates the return time by subtracting a value obtained by dividing a difference between the upper limit of electric energy and the electric energy consumption by the reference electric energy consumption from a predetermined maximum possible return time.

$$\text{Return time} = \text{maximum possible return time} - (\text{upper limit of electric energy} - \text{electric energy consumption})/\text{reference electric energy consumption} \quad (1)$$

The upper limit of electric energy here is maximum electric energy consumption in a certain period of time, and is stored in a storage medium, such as the MEM-C 107 or the HDD 108, in advance. The maximum possible return time here is estimated in advance to be longer than the return time in the low-power mode and to be a return time acceptable to a user (up to about 2 to 3 minutes). The maximum possible return time is stored in a storage medium, such as the MEM-C 107 or the HDD 108, in advance. The reference electric energy consumption, which is electric energy consumption per unit time, is arbitrarily adjusted based on the upper limit of electric energy.

The equation (1) shows that the return time is a difference between the maximum possible return time and a time obtained by converting remaining electric energy using the reference electric energy consumption.

The return-latency calculating unit 305 calculates a return latency by subtracting the return time from the possible return time corresponding to the current operation mode.

The informing unit 304 informs a user of the return time as a status of power consumption by displaying the return time on the liquid crystal panel of the operation display unit 400 at the time of return from the energy reduction mode to the normal mode.

Subsequently, a return process for returning from the energy reduction mode to the normal mode performed by the MFP according to the present embodiment is explained. The MFP being on standby (i.e., in a power-saving state or a power-off state) starts performing the return process when the main power switch is turned on, or when a top panel of the copier is opened, or when there is a request for a print job, etc.

Figure 5:
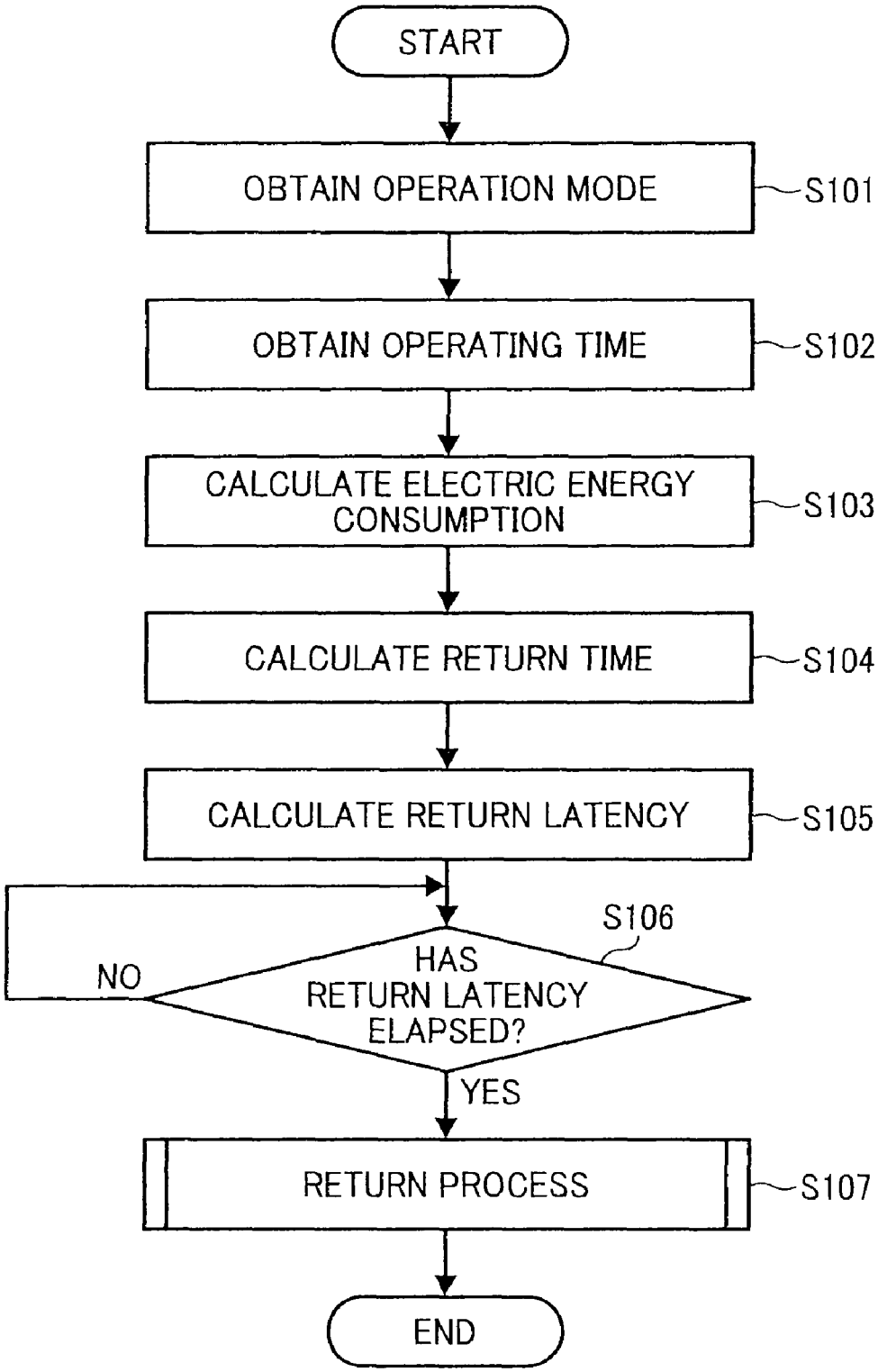
FIG. 5 is a flowchart illustrating a procedure of a return process according to the first embodiment.

FIG. 5 is a flowchart illustrating a procedure of the return process according to the first embodiment. As shown in FIG. 5, at the time of return, first, the electric-energy accumulating unit 301 obtains the current (i.e., before the return) operation mode(s) (not always one operation mode) stored in the storage unit of the controller 101, such as the MEM-C 107 or the HDD 108 (Step S101). Then, the electric-energy accumulating unit 301 obtains an operating time (an operating time in the operation mode before the return) from a real-time clock (RTC) stored in the controller 101 (Step S102).

Then, the electric-energy accumulating unit 301 reads out reference electric energy consumption (electric energy consumption per unit time) corresponding to the current operation mode from the reference electric energy consumption table 311, and calculates (accumulates) electric energy consumption in the current operation mode by multiplying the reference electric energy consumption by the operating time obtained at Step S102 (Step S103).

Then, the return-time calculating unit 302 reads out the upper limit of electric energy assigned to a certain period of time and the maximum possible return time from the MEM-C 107 or the like, and calculates a return time using the equation (1) on the basis of the electric energy consumption calculated at Step S103 and the reference electric energy consumption corresponding to the current operation mode (Step S104).

Then, the return-latency calculating unit 305 reads out the possible return time corresponding to the current operation mode obtained at Step S101 from the possible return time table 312, and calculates a return latency by calculating a difference between the return time calculated at Step S104 and the possible return time (return latency=possible return time−return time) (Step S105).

Then, the mode control unit 303 determines whether the return latency calculated at Step S105 has elapsed (Step S106), and when the return latency has elapsed (YES at Step S106), performs the return process (Step S107).

An example of calculation of a return time at Step S104 is explained under the assumption, for example, that the operation mode according to the present embodiment includes the normal mode, the standby mode, the energy-saving mode, and the low-power mode, and respective reference electric energy consumptions in these operation modes are, as shown in the reference electric energy consumption table 311 in FIG.

4A, 1000 Wh in the normal mode, 500 Wh in the standby mode, 300 Wh in the energy-saving mode, and 100 Wh in the low-power mode. Furthermore, it is assumed that respective possible return times taken to return from the respective operation modes to the normal mode are, as shown in the possible return time table 312 in FIG. 4B, 0 second in the normal mode, 20 seconds in the standby mode, 30 seconds in the energy-saving mode, and 40 seconds in the low-power mode.

In this case, for example, when it is assumed that the maximum possible return time is 50 seconds, the upper limit of electric energy is 50 KWh, electric energy consumption is 20 KWh, and unit power consumption is 1000 W, assigning these values into the equation (1), a return time=40-(50 KWh−20 KWh)/1000 W, i.e., the return time is 10 seconds. Incidentally, if the return time is 0 or less, the return time is set down as 0; if the return time exceeds the maximum possible return time, the return time is set at the maximum possible return time.

In this manner, in the MFP according to the first embodiment, a return time taken for the MFP to return from the energy reduction mode to the normal mode is controlled based on power consumption in the operation mode before the return, whereby electric energy consumption can be restrained while maintaining the operating rate of the MFP appropriately. Furthermore, in the MFP according to the first embodiment, the operation mode and the operating time are used for accumulation of electric energy consumption, so there is no need to add an electric-energy measurement sensor for accumulating electric energy, etc.; therefore, it is possible to reduce the production cost.

Figure 6:
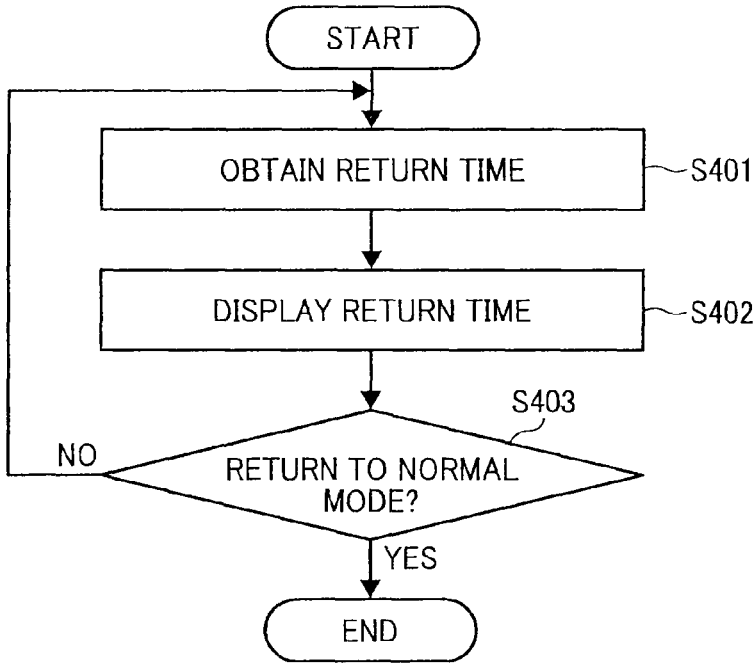
FIG. 6 is a flowchart illustrating a detailed procedure of the return process for returning to a normal mode according to the first embodiment.

Subsequently, details of the return process for returning to the normal mode at Step S107 are explained. FIG. 6 is a flowchart illustrating a detailed procedure of the return process for returning to the normal mode according to the first embodiment.

At the time of return, first, the informing unit 304 obtains the return time calculated at Step S104 from the return-time calculating unit 302 (Step S401), and displays the obtained return time on the liquid crystal panel of the operation display unit 400 (Step S402). Then, the informing unit 304 repeatedly performs the processes at Steps S401 and S402 until the MFP returns to the normal mode (NO at Step S403). When the MFP returns to the normal mode (YES at Step S403), the informing unit 304 displays a time actually taken for the MFP to return to the normal mode on the liquid crystal panel of the operation display unit 400. Incidentally, in addition to displaying the time on the liquid crystal panel of the operation display unit 400, the informing unit 304 can inform a user of the return by a means such as light or sound.

By informing the user of a status of power consumption by displaying the return time on the panel of the operation display unit, it can be expected that the user is conscious of saving on electricity. Furthermore, it is possible to prevent the possibility that the user mistakenly recognizes that the MFP is out of order when it takes a long time to return.

Incidentally, the informing unit 304 according to the present embodiment displays a return time and a time actually taken for the MFP to return to the normal mode on the liquid crystal panel of the operation display unit 400; however, the present invention is not limited to this. For example, the informing unit 304 can be configured to display a remaining time for the MFP to return to the normal mode on the liquid crystal panel of the operation display unit 400 while counting down the remaining time with time. By this, a user can see a countdown of the time for the MFP to return, so it is more convenient for the user.

Figure 7:
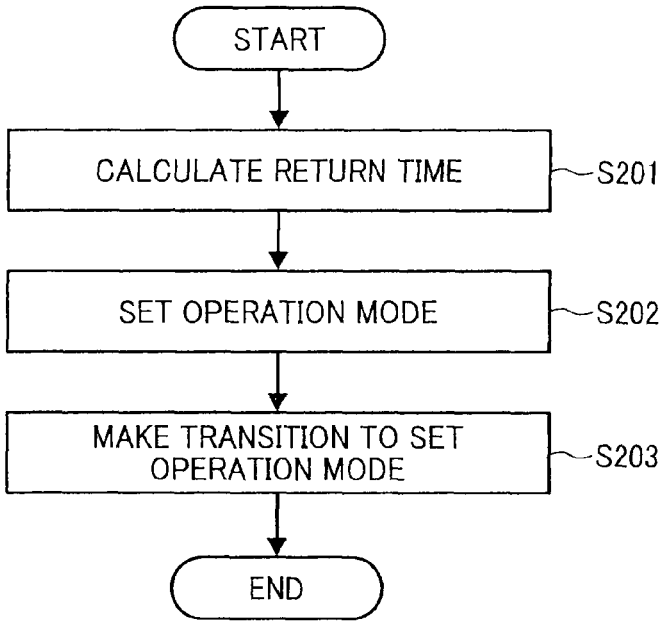
FIG. 7 is a flowchart illustrating a procedure of a transition process of making the transition from the normal mode to an energy reduction mode according to the first embodiment.

Subsequently, a transition process of how the MFP makes the transition from the normal mode to the energy reduction mode after completion of a job, such as a print job, is explained. FIG. 7 is a flowchart illustrating a procedure of the transition process of making the transition from the normal mode to the energy reduction mode according to the first embodiment.

In the MFP, when a certain period of time has elapsed after completion of a job, such as a print job (for example, 5 minutes has elapsed upon receipt of a notification of job completion from the controller 101), the mode control unit 303 causes the MFP to make the transition to the energy reduction mode. At the transition to the energy reduction mode, first, the return-time calculating unit 302 calculates a return time using the equation (1) in the same manner as at the return from the energy reduction mode to the normal mode (Step S201).

Then, the mode control unit 303 obtains the operation mode corresponding to a possible return time being consistent with the calculated return time from the possible return time table 312, and sets the obtained operation mode as the operation mode to which the MFP makes the transition (Step S202). Then, the mode control unit 303 causes the MFP to make the transition to the set operation mode (Step S203).

For example, the mode control unit 303 causes the MFP to make the transition to the low-power mode if the return time is 40 seconds or more, the transition to the energy-saving mode if the return time is 30 seconds or more but less than 40 seconds, and the transition to the standby mode if the return time is 20 seconds or more but less than 30 seconds. After the mode transition is made, the transition process is terminated.

In this manner, in the MFP according to the present embodiment, after completion of a job, the operation mode can be changed to any of the energy reduction modes, and thus, it is possible to restrain power consumption while the MFP is on standby, depending on a status of power consumption based on a return time to return to the energy reduction mode.

Second Embodiment

An MFP according to a second embodiment performs the setting of a return time in addition to the functions described in the first embodiment.

Figure 8:
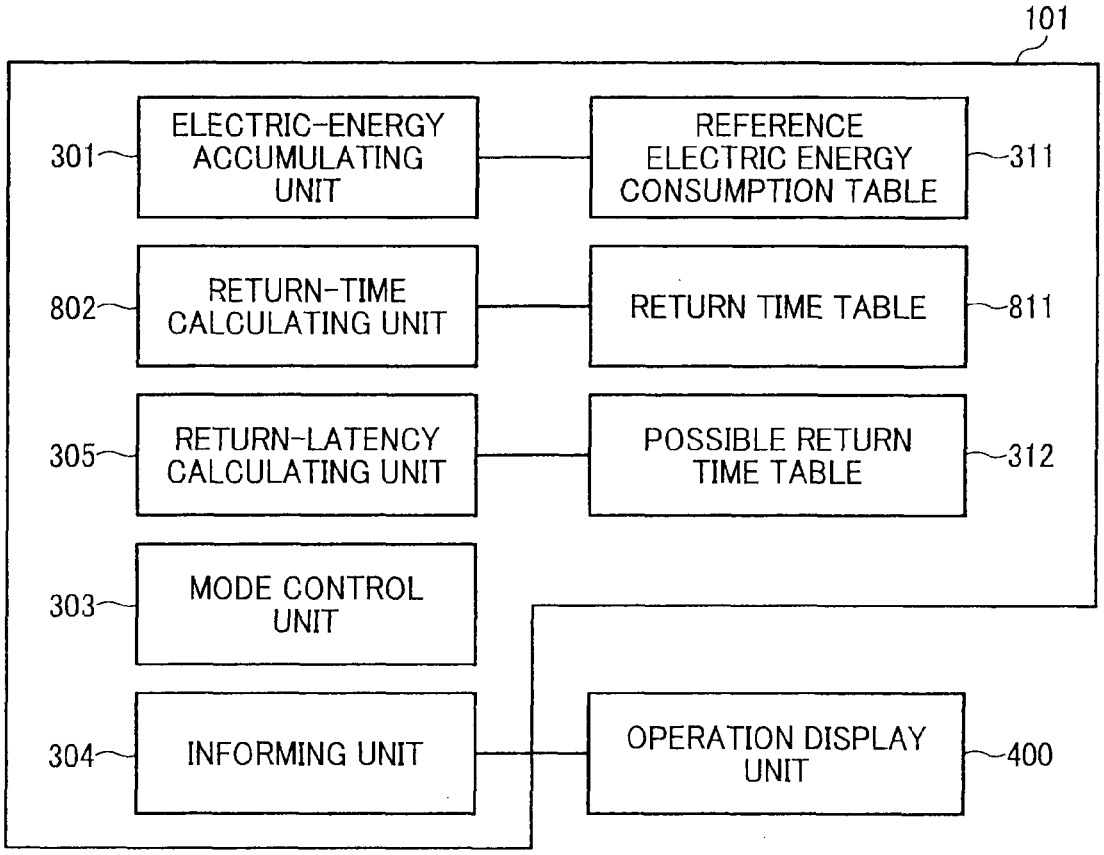
FIG. 8 is a block diagram illustrating a functional configuration of a controller of an MFP according to a second embodiment.

FIG. 8 is a block diagram illustrating a functional configuration of the controller 101 of the MFP according to the second embodiment. Incidentally, a general configuration of the MFP according to the second embodiment and a configuration of a control circuit of the system management unit 100 are identical to those in the first embodiment as shown in FIGS. 1 and 2.

As shown in FIG. 8, the controller 101 according to the second embodiment mainly includes the electric-energy accumulating unit 301, a return-time calculating unit 802, the return-latency calculating unit 305, the mode control unit 303, the informing unit 304, the reference electric energy consumption table 311, a return time table 811, and the possible return time table 312. The configurations and functions of the electric-energy accumulating unit 301, the return-latency calculating unit 305, the mode control unit 303, the informing unit 304, the reference electric energy consumption table 311, and the possible return time table 312 are identical to those in the first embodiment.

The return-time calculating unit 802 has the same function as the return-time calculating unit 302 in the first embodiment, and further performs the setting of a return time when the MFP is made return from the energy reduction mode to the normal mode or the transition from the normal mode to the energy reduction mode by the mode control unit 303.

Figures 9, 10:
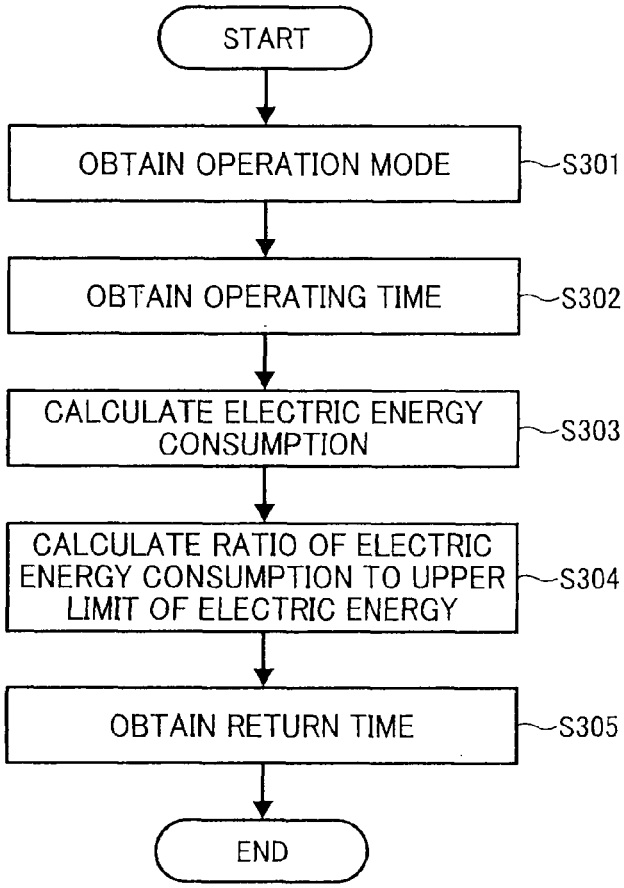
FIG. 9 is an explanatory diagram showing an example of a return time table according to the second embodiment.
FIG. 10 is a flowchart illustrating a procedure of a return-time setting process according to the second embodiment.

The return time table 811 is a table defining a return time depending on a reference-value ratio, which is a ratio of electric energy consumption to an upper limit of electric energy (reference electric energy consumption). This return time table 811 is stored in a storage medium, such as the MEM-C 107 or the HDD 108. FIG. 9 is an explanatory diagram showing an example of the return time table 811 according to the second embodiment. As shown in FIG. 9, in the return time table 811, a return time is set to be associated with the reference-value ratio, and it is set that the higher the reference-value ratio is, i.e., the higher the electric energy consumption is, the longer the return time is.

Subsequently, a return-time setting process according to the present embodiment is explained. FIG. 10 is a flowchart illustrating a procedure of the return-time setting process according to the second embodiment.

First, the electric-energy accumulating unit 301 obtains the already-implemented operation mode from a storage medium, such as the MEM-C 107 (Step S301). Then, the electric-energy accumulating unit 301 obtains an operating time in the already-implemented operation mode from the RTC (Step S302).

Then, the electric-energy accumulating unit 301 obtains reference electric energy consumption corresponding to the already-implemented operation mode from the reference electric energy consumption table 311, and, in the same manner as in the first embodiment, calculates electric energy consumption by multiplying the reference electric energy consumption by the corresponding operating time (Step S303).

Then, the return-time calculating unit 802 calculates a ratio of the calculated electric energy consumption to the upper limit of electric energy stored in the MEM-C in advance (a reference-value ratio) (Step S304). Then, the return-time calculating unit 802 obtains a return time corresponding to the calculated reference-value ratio from the return time table 811, and sets the obtained return time (Step S305).

In the return time table 811 shown in FIG. 9, a longer return time is set as electric energy consumption gets higher, so that it is possible to adjust the operating rate of the MFP.

(First Variation)

FIG. 11 is an explanatory diagram showing another example of the return time table 811 according to the second embodiment. In the example shown in FIG. 11, in the return time table 811, a return time is set to be associated with remaining electric energy, which is a difference between the upper limit of electric energy and electric energy consumption, and it is set that the higher the electric energy consumption is, i.e., the lower the remaining electric energy is, the longer the return time is.

In a case of using the return time table 811 shown in FIG. 11, at Step S304 described above, the return-time calculating unit 802 calculates, as remaining electric energy, a difference between the upper limit of electric energy and the calculated electric energy consumption. Then, at Step S305, the return-time calculating unit 802 obtains a return time corresponding to the calculated remaining electric energy from the return time table 811 shown in FIG. 11, and sets the obtained return time.

In the return time table 811 shown in FIG. 11, a longer return time is set as remaining electric energy gets lower to adjust the operating rate of the image forming apparatus, so that it is possible to restrain electric energy consumption.

(Second Variation)

However, when the predetermined upper limit of electric energy and electric energy consumption are used for calculation of a return time as described above, the use of the MFP may be limited in the latter half in terms of time, such as at the end of the month requiring the high operating rate, because a return time gets longer with time in general.

In this case, for example, a term-specific return time table 811 provided for each term shown in FIG. 12 may be used. As shown in FIG. 12, when a term of the upper limit of electric energy is set at one month (30 days), the operating rate is adjusted by setting a longer return time in the beginning of the month in which the operating rate is expected to be relatively low. Furthermore, a shorter return time is set in the latter part of the month in which the operating rate is expected to be relatively high, so that it is possible to respond to a request for the high operating rate.

Namely, to cope with a problem of the MFP that as a return time gets shorter, the operating rate and electric energy consumption increase, by using the term-specific return time table 811 shown in FIG. 12, the return time is controlled, whereby electric energy consumption can be kept within the predetermined upper limit of electric energy while achieving a balance between the operating rate and the electric energy consumption.

(Third Variation)

In the above first and second embodiments, the informing unit 304 informs a user of a status of power consumption by displaying a return time on the liquid crystal panel of the operation display unit 400; however, the user may not be able to easily determine whether it is excess consumption based on the information on the status of power consumption only. In case of such a situation, a process for changing display content depending on a return time is explained below.

Figures 13, 14:
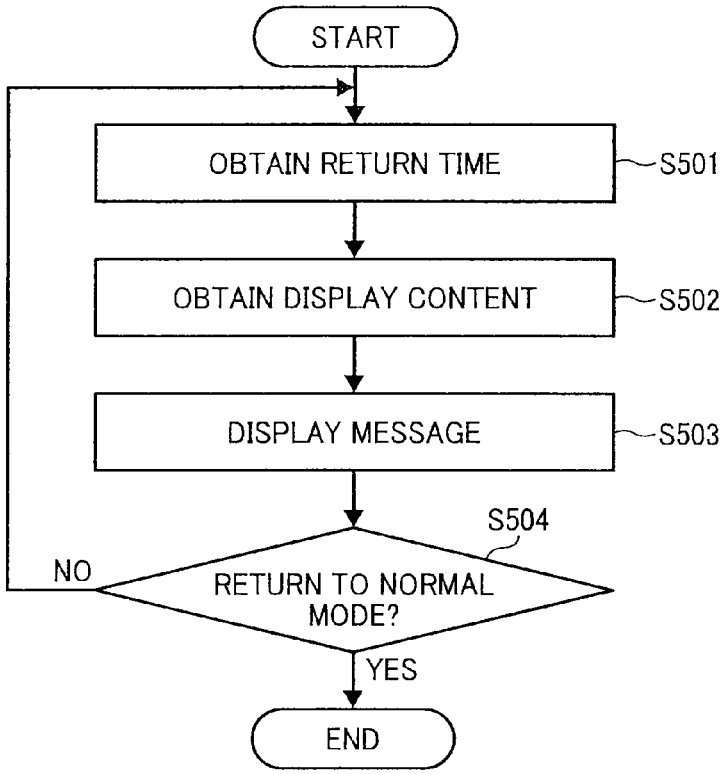
FIG. 13 is a flowchart illustrating a procedure of a process of changing a message displayed on a liquid crystal panel of an operation display unit depending on a return time according to a third variation.
FIG. 14 is an explanatory diagram showing an example of a message table.

FIG. 13 is a flowchart illustrating a procedure of a process of changing a message displayed on the liquid crystal panel of the operation display unit depending on a return time according to a third variation. The informing unit 304 obtains a return time from the return-time calculating unit 302 (Step S501). Then, the informing unit 304 obtains display content of a message depending on the return time from a message table T6 stored in a storage medium, such as the MEM-C 107 (Step S502).

FIG. 14 is an explanatory diagram showing an example of the message table T6. As shown in FIG. 14, in the message table, different messages depending on return times are set.

Then, the informing unit 304 displays the message obtained from the message table T6 on the liquid crystal panel of the operation display unit 400 (Step S503).

The informing unit 304 displays a message by performing the processes at Steps S501 to S503 repeatedly until the return to the normal mode is completed (NO at Step S504). When the return to the normal mode is completed (YES at Step S504), the process is terminated. Incidentally, the display content can be changed by changing the message in the message table T6 to suit the user's convenience.

Namely, the message is changed by the informing unit 304 or a newly-provided information-content changing unit in accordance with a status of power consumption, so that a user can easily understand the status of power consumption, and it can be expected that the user is conscious of saving on electricity.

Furthermore, it can be configured to display a message guiding a user to perform an operation instead of the message shown in FIG. 14.

Third Embodiment

In the MFP according to the first and second embodiments, a return time taken to return from the energy reduction mode to the normal mode is calculated on the basis of electric power consumption; in a third embodiment, a return time is calculated on the basis of consumption of carbon dioxide ($CO_2$)

(hereinafter, referred to as "$CO_2$ consumption"), and a return process is performed based on the calculated return time.

Figure 15:
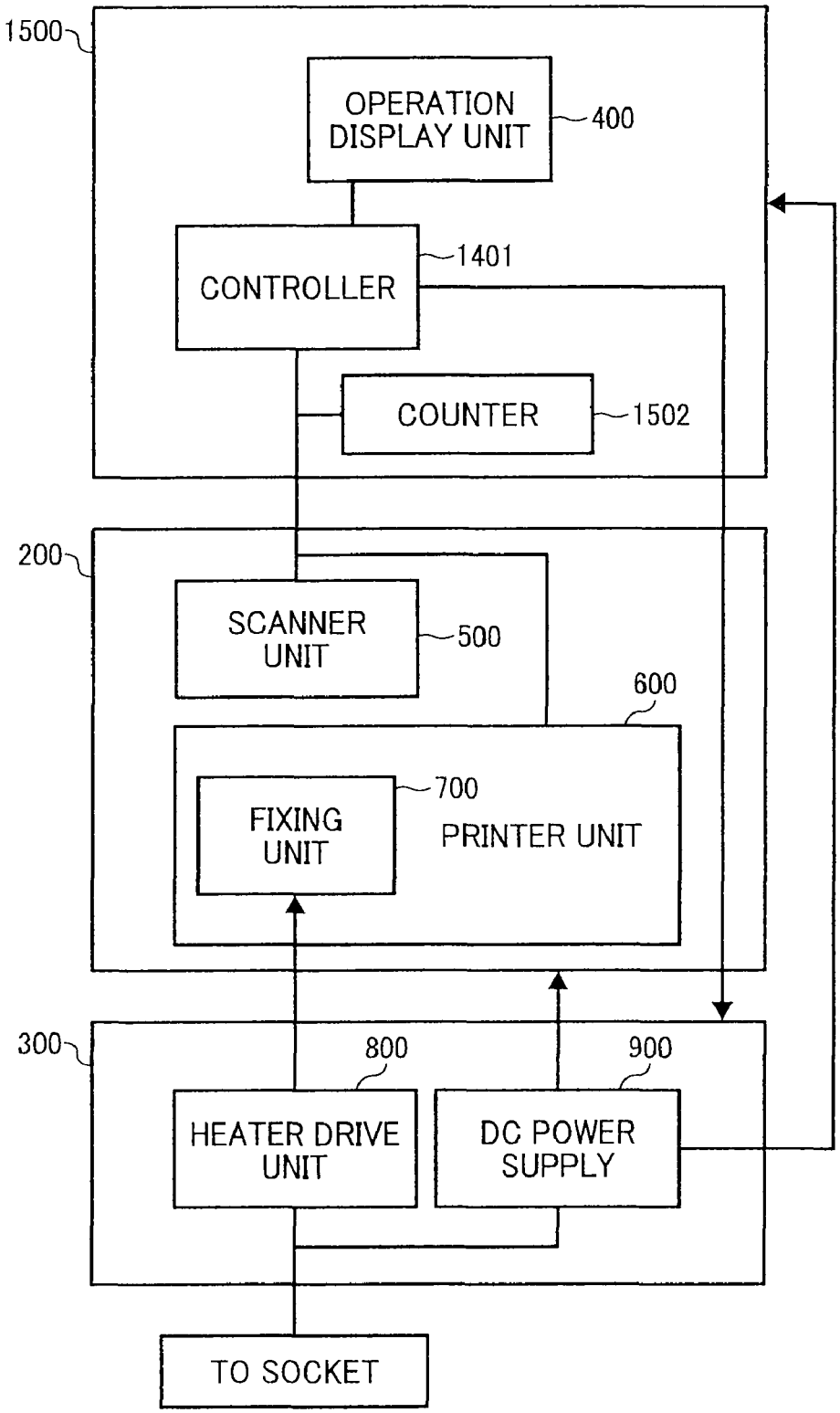
FIG. 15 is a schematic configuration diagram of an MFP according to a third embodiment.

FIG. 15 is a schematic configuration diagram of an MFP according to the third embodiment. As shown in FIG. 15, in the MFP, a system management unit 1500, including controller loads such as a controller 1401 and the operation display unit 400, and the engine unit 200, including engine loads such as the scanner unit 500 and the printer unit 600, are each supplied with electric power from the power supply unit 300. The power supply unit 300 is composed of the DC power supply 900 and the heater drive unit 800. The DC power supply 900 supplies electric power to the system management unit 1500 and the engine unit 200. The heater drive unit 800 supplies electric power to the fixing unit 700 of the printer unit 600.

In the present embodiment, the system management unit 1500 includes a counter 1502. The counter 1502 counts the number of sheets to be output when the controller 1401 causes the printer unit 600 to execute a print job.

Also in the present embodiment, in the same manner as in the first embodiment, to make the MFP operate in the energy reduction mode, the system management unit 1500 controls the engine unit 200 and the power supply unit 300. Furthermore, the controller 1401 in the present embodiment calculates $CO_2$ consumption, and calculates a return time taken for the MFP to return from the energy reduction mode to the normal mode on the basis of the $CO_2$ consumption.

Except for the counter 1502 and the controller 1401, a control circuit of the system management unit 1500 has the same configuration as that of the system management unit 100 in the first embodiment.

Figure 16:
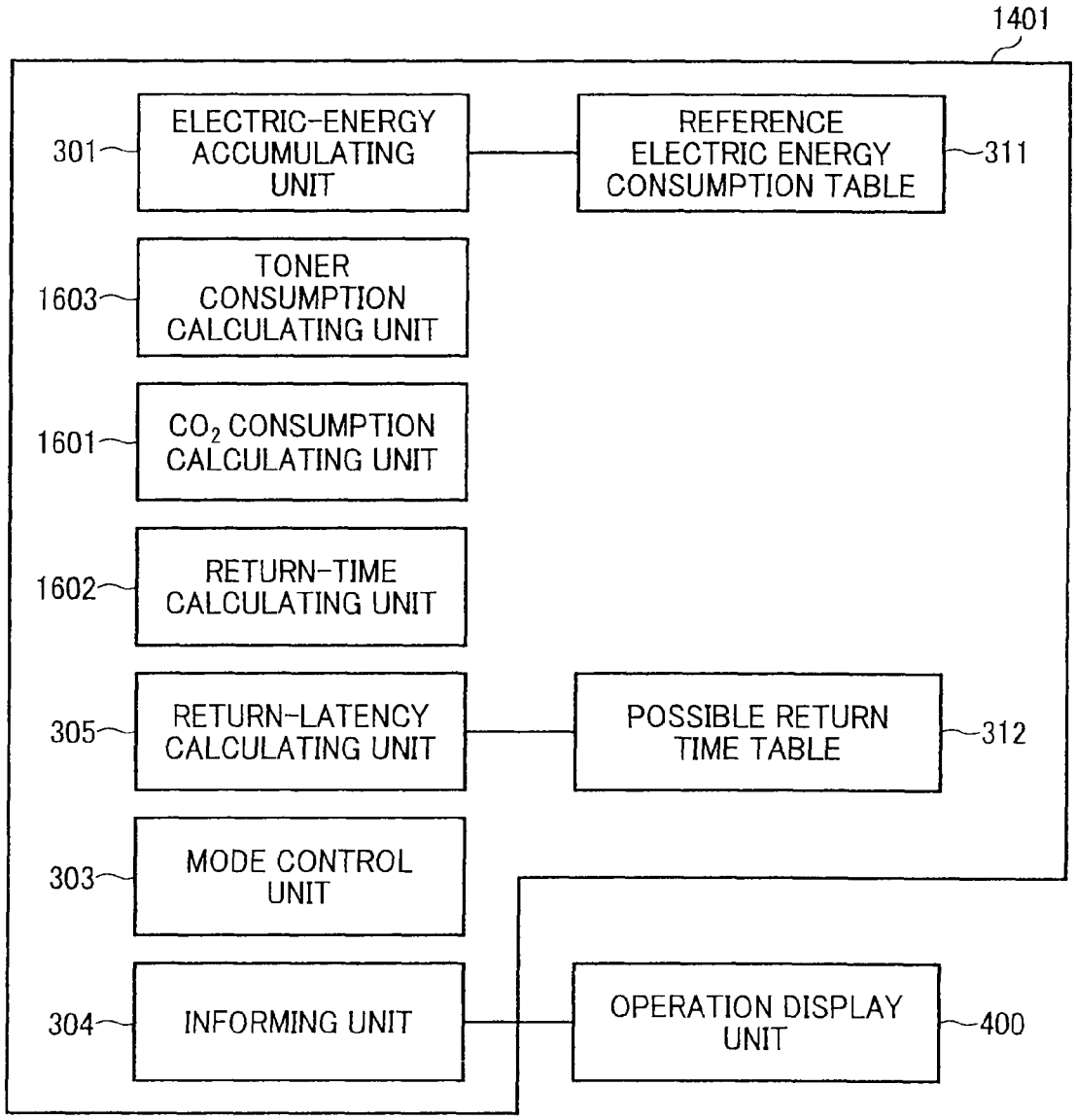
FIG. 16 is a block diagram illustrating a functional configuration of a controller according to the third embodiment.

FIG. 16 is a block diagram illustrating a functional configuration of the controller 1401 according to the third embodiment. As shown in FIG. 16, the controller 1401 mainly includes the electric-energy accumulating unit 301, a toner consumption calculating unit 1603, a $CO_2$ consumption calculating unit 1601, a return-time calculating unit 1602, the return-latency calculating unit 305, the mode control unit 303, the informing unit 304, the reference electric energy consumption table 311, and the possible return time table 312.

The configurations and functions of the electric-energy accumulating unit 301, the return-latency calculating unit 305, the mode control unit 303, the informing unit 304, the reference electric energy consumption table 311, and the possible return time table 312 are identical to those in the first embodiment.

The toner consumption calculating unit 1603 is notified of the number of dots drawn per one page of image data and the number of pages to be output at the printer output by the CPU 102 that performs image processing, and calculates toner consumption in the current operation mode using the following equation (2).

$$\text{Toner consumption}=(\text{the number of dots drawn per page}\times\text{coefficient 1})\times\text{the number of pages to be output} \quad (2)$$

The coefficient 1 here depends on characteristics of a printer engine connected to the printer unit 600, so the coefficient 1 is obtained with respect to each printer engine. Considering duplex printing, the number of pages to be output does not always coincide with the number of sheets to be output counted by the counter 1502.

The $CO_2$ consumption calculating unit 1601 calculates $CO_2$ consumption using the following equation (3) on the basis of electric energy consumption in the current operation mode (the operation mode before the return) which is calculated by the electric-energy accumulating unit 301 in the same manner as that is in the first embodiment, the number of sheets to be output counted by the counter 1502, and toner consumption calculated by the toner consumption calculating unit 1603.

$$CO_2\text{ consumption}=\text{electric energy consumption}\times\text{coefficient 2}+\text{the number of sheets to be output}\times\text{coefficient 3}+\text{toner consumption}\times\text{coefficient 4} \quad (3)$$

The coefficients 1 to 4 in the above equations (2) and (3) are predetermined, for example, based on information, such as a reference material, "Calculation Formula for Calculating Greenhouse Gas Emissions and List of Emission Coefficients" in "the Guidelines for Establishment of Program on Regional Promotion of Global Warming Countermeasures (third edition)", March 2007, Global Environment Bureau, Ministry of the Environment (http://www.env.go.jp/earth/ondanka/suishin_g/index.html).

The return-time calculating unit 1602 calculates a return time taken for the MFP to return from the energy reduction mode to the normal mode on the basis of the $CO_2$ consumption calculated by the $CO_2$ consumption calculating unit 1601, an upper limit of $CO_2$ consumption assigned to a certain period of time, and the reference electric energy consumption. More specifically, as shown in the following equation (4), the return-time calculating unit 1602 calculates a return time by subtracting a value obtained by dividing a difference between the upper limit of $CO_2$ consumption and the $CO_2$ consumption by the reference electric energy consumption from a predetermined maximum possible return time.

$$\text{Return time}=\text{maximum possible return time}-(\text{upper limit of }CO_2\text{ consumption}-CO_2\text{ consumption})/\text{reference electric energy consumption} \quad (4)$$

The upper limit of $CO_2$ consumption here is maximum $CO_2$ consumption in a certain period of time, and is stored in a storage medium, such as the MEM-C 107 or the HDD 108, in advance. The maximum possible return time and the reference electric energy consumption are the same as in the first embodiment.

Furthermore, the return-time calculating unit 1602 can calculate the return time taken for the MFP to return from the energy reduction mode to the normal mode on the basis of electric energy consumption in the same manner as the return-time calculating unit 302 in the first embodiment.

Subsequently, a return process for returning from the energy reduction mode to the normal mode performed by the MFP according to the present embodiment is explained.

Figure 17:
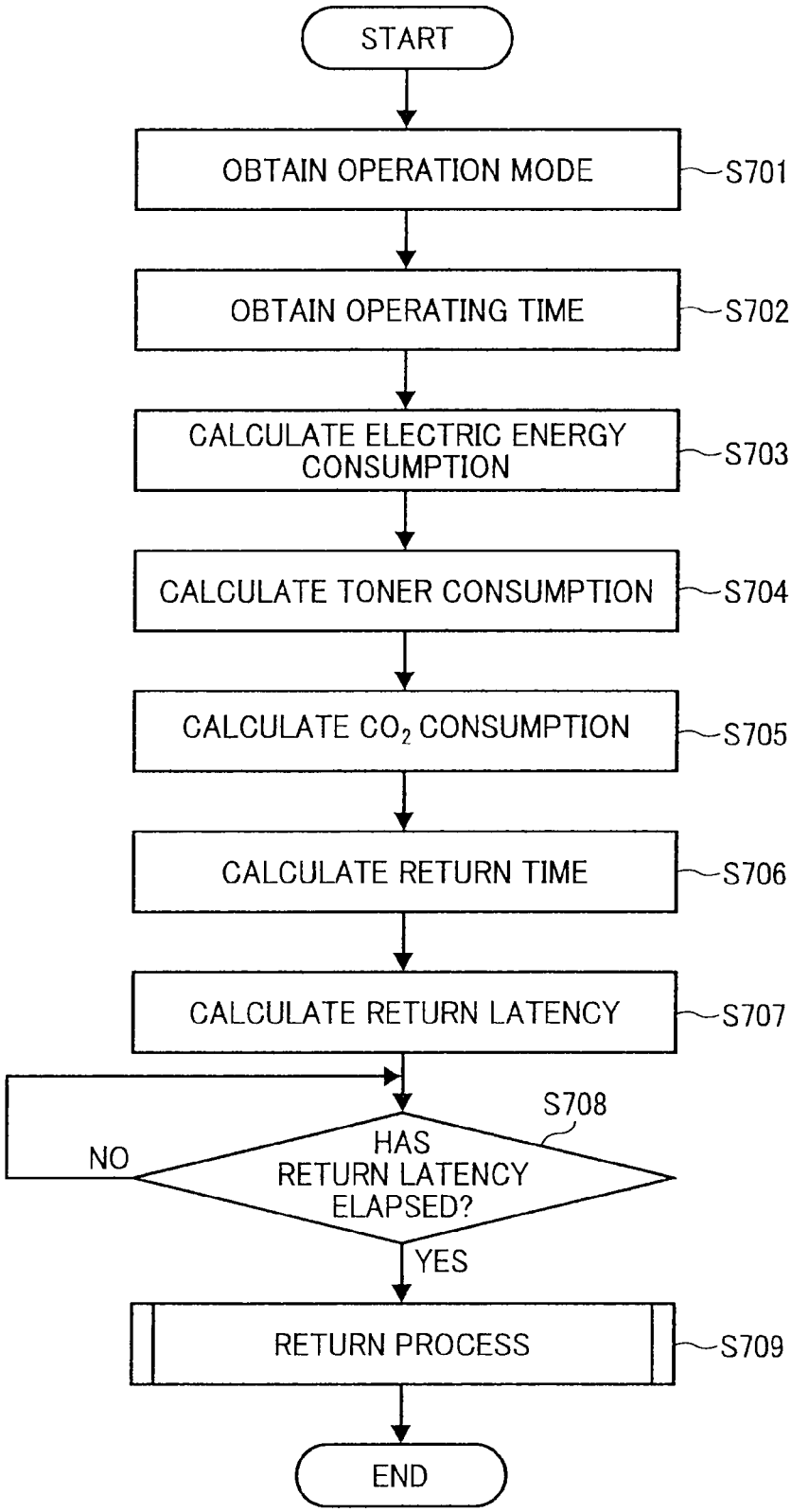
FIG. 17 is a flowchart illustrating a procedure of a return process according to the third embodiment.

FIG. 17 is a flowchart illustrating a procedure of the return process according to the third embodiment. As shown in FIG. 17, at the time of return, first, the electric-energy accumulating unit 301 obtains the current (i.e., before the return) operation mode(s) (not always one operation mode) stored in the storage unit of the controller 1401, such as the MEM-C 107 or the HDD 108 (Step S701). Then, the electric-energy accumulating unit 301 obtains an operating time (an operating time in the operation mode before the return) from the RTC (Step S702).

Then, the electric-energy accumulating unit 301 reads out reference electric energy consumption corresponding to the current operation mode from the reference electric energy consumption table 311, and calculates electric energy consumption in the current operation mode by multiplying the reference electric energy consumption by the operating time obtained at Step S702 (Step S703).

Then, the toner consumption calculating unit 1603 calculates toner consumption in the current operation mode using the equation (2) on the basis of the number of dots drawn per page and the number of pages to be output that are obtained based on image data (Step S704).

Then, the $CO_2$ consumption calculating unit 1601 calculates $CO_2$ consumption using the equation (3) on the basis of the electric energy consumption in the current operation mode (the operation mode before the return) calculated at Step S703, the number of sheets to be output counted by the counter 1502, and the toner consumption calculated by the toner consumption calculating unit 1603 (Step S705).

Then, the return-time calculating unit 1602 reads out the upper limit of $CO_2$ consumption assigned to a certain period of time and the maximum possible return time from the MEM-C 107 or the like, and calculates a return time using the equation (4) on the basis of the $CO_2$ consumption calculated at Step S705 and the reference electric energy consumption corresponding to the current operation mode (Step S706). The subsequent steps in the return process (Steps S707 to S709) are performed in the same manner as Steps S105 to S107 in the first embodiment.

In this manner, in the MFP according to the third embodiment, a return time is calculated on the basis of $CO_2$ consumption, and the return process is performed based on the calculated return time, so there is no need to add an electric-energy measurement sensor for accumulating electric energy, etc.; therefore, it is possible to reduce the production cost.

Incidentally, a return processing program executed by the MFP according to the first to third embodiments is incorporated in a ROM or the like in advance and provided.

The return processing program executed by the MFP according to the first to third embodiments can be provided in such a manner that the return processing program is recorded on a computer-readable recording medium, such as a CD-ROM, a flexible disk (FD), a CD-R, or a digital versatile disk (DVD), in an installable or executable file format.

Furthermore, the return processing program executed by the MFP according to the first to third embodiments can be stored on a computer connected to a network, such as the Internet, so that the return processing program can be provided by causing a user to download the return processing program over the network.

Moreover, the return processing program executed by the MFP according to the first to third embodiments can be provided or distributed via a network, such as the Internet.

The return processing program executed by the MFP according to the first to third embodiments is configured to be composed of modules including the units described above (the electric-energy accumulating unit 301, the return-time calculating unit 302 or 1602, the return-latency calculating unit 305, the mode control unit 303, the informing unit 304, the toner consumption calculating unit 1603, and the $CO_2$ consumption calculating unit 1601). In actual hardware, the CPU (a processor) reads out the return processing program from the ROM, and executes the return processing program, whereby the above units are loaded on a main memory unit, and the electric-energy accumulating unit 301, the return-time calculating unit 302 or 1602, the return-latency calculating unit 305, the mode control unit 303, the informing unit 304, the toner consumption calculating unit 1603, and the $CO_2$ consumption calculating unit 1601 are implemented on the main memory unit.

Incidentally, in the above embodiments, there is described an example where the image forming apparatus according to the present invention is applied to an MFP having at least two of the copy, print, scan, and fax functions; however, the image forming apparatus according to the present invention is not limited to the MFP. The image forming apparatus according to the present invention can be applied to any of a copier, a printer, a scanner, and a facsimile machine.

According to the embodiments of the present invention, by controlling a return time taken for the image forming apparatus to return from the energy reduction mode to the normal mode, electric energy consumption can be restrained while maintaining the operating rate of the apparatus appropriately.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus having a plurality of operation modes with different power supply conditions, the image forming apparatus comprising:

an electric-energy accumulating unit that calculates electric energy consumption in a current operation mode;

a return-time calculating unit that calculates a return time taken for the image forming apparatus to return from an energy reduction mode, which is the operation mode in which part of the image forming apparatus is supplied with electric power, to a normal mode, which is the operation mode in which the whole image forming apparatus is supplied with electric power, on the basis of the calculated electric energy consumption and an upper limit of electric energy, which is predetermined as maximum electric energy consumption in a certain period of time; and a mode control unit that makes the image forming apparatus return from the energy reduction mode to the normal mode on the basis of the calculated return time.

2. The image forming apparatus according to claim 1, further comprising a first storage unit that stores therein reference electric energy consumption, which is set as electric energy consumption per unit time in each of the operation modes in advance, wherein the electric-energy accumulating unit calculates the electric energy consumption by multiplying the reference electric energy consumption in the current operation mode by an operating time in the current operation mode.

3. The image forming apparatus according to claim 2, wherein the return-time calculating unit calculates the return time on the basis of the electric energy consumption, the upper limit of electric energy, and the reference electric energy consumption.

4. The image forming apparatus according to claim 3, wherein the return-time calculating unit calculates the return time by subtracting a value obtained by dividing a difference between the upper limit of electric energy and the electric energy consumption by the reference electric energy consumption from a predetermined maximum possible return time.

5. The image forming apparatus according to claim 1, further comprising:

a second storage unit that stores therein a possible return time, which is a possible time taken for the image forming apparatus to return from the energy reduction mode to the normal mode, in each of the operation modes; and a return-latency calculating unit that calculates a return latency by subtracting the return time from the possible return time corresponding to the current operation mode stored in the second storage unit, wherein the mode control unit makes the image forming apparatus return from the energy reduction mode to the normal mode after a lapse of the return latency.

6. The image forming apparatus according to claim 1, wherein the energy reduction mode includes a plurality of different operation modes, the return-time calculating unit further calculates a return time taken for the image forming apparatus to return from the normal mode to the energy reduction mode on the basis of the electric energy consumption in the normal mode and the upper limit of electric energy, and the mode control unit determines any of the energy reduction modes to which the image forming apparatus makes the transition on the basis of the return time at the transition from the normal mode to the energy reduction mode.

7. The image forming apparatus according to claim 1, wherein the return-time calculating unit further calculates the return time on the basis of the electric energy consumption in the current operation mode and the upper limit of electric energy when the image forming apparatus makes the transition between the normal mode and the energy reduction mode, and sets the calculated return time.

8. The image forming apparatus according to claim 7, wherein the return-time calculating unit obtains the longer return time as a reference ratio, which is a ratio of the electric energy consumption in the current operation mode to the upper limit of electric energy, gets higher.

9. The image forming apparatus according to claim 7, wherein the return-time calculating unit obtains the longer return time as remaining electric energy, which is a difference between the upper limit of electric energy and the electric energy consumption in the current operation mode, gets lower.

10. The image forming apparatus according to claim 9, wherein the return-time calculating unit obtains the longer return time as the remaining electric energy gets lower on a term-by-term basis.

11. The image forming apparatus according to claim 1, further comprising a carbon-dioxide-consumption calculating unit that calculates carbon dioxide consumption in the current operation mode, wherein the return-time calculating unit further calculates the return time taken for the image forming apparatus to return from the energy reduction mode to the normal mode on the basis of the calculated carbon dioxide consumption and an upper limit of carbon dioxide consumption, which is predetermined as maximum carbon dioxide consumption in a certain period of time.

12. The image forming apparatus according to claim 11, further comprising:

a toner-consumption calculating unit that calculates toner consumption at the time of image formation and output; and a counting unit that counts the number of sheets output at the time of image formation and output, wherein the carbon-dioxide-consumption calculating unit calculates the carbon dioxide consumption on the basis of the electric energy consumption in the current operation mode, the number of sheets output, and the toner consumption.

13. The image forming apparatus according to claim 1, further comprising an informing unit that informs a user of a status of power consumption of the image forming apparatus at the time of return from the energy reduction mode to the normal mode.

14. The image forming apparatus according to claim 13, wherein the informing unit informs a user of the return time as the status of power consumption.

15. The image forming apparatus according to claim 13, wherein the informing unit informs a user of, as the status of power consumption, a remaining time to a completion of the return while counting down the remaining time with time.

16. The image forming apparatus according to claim 13, wherein the informing unit changes information content depending on the status of power consumption.

17. A return processing method implemented by an image forming apparatus having a plurality of operation modes with different power supply conditions, the return processing method comprising:

calculating electric energy consumption in a current operation mode;

calculating a return time taken for the image forming apparatus to return from an energy reduction mode, which is the operation mode in which part of the image forming apparatus is supplied with electric power, to a normal mode, which is the operation mode in which the whole image forming apparatus is supplied with electric power, on the basis of the calculated electric energy consumption and an upper limit of electric energy, which is predetermined as maximum electric energy consumption in a certain period of time; and making the image forming apparatus return from the energy reduction mode to the normal mode on the basis of the calculated return time.

18. A computer program product comprising a computer-usable medium having computer-readable program codes, wherein the program codes when executed causing a computer in an image forming apparatus having a plurality of operation modes with different power supply conditions to execute:

calculating electric energy consumption in a current operation mode;

calculating a return time taken for the image forming apparatus to return from an energy reduction mode, which is the operation mode in which part of the image forming apparatus is supplied with electric power, to a normal mode, which is the operation mode in which the whole image forming apparatus is supplied with electric power, on the basis of the calculated electric energy consumption and an upper limit of electric energy, which is predetermined as maximum electric energy consumption in a certain period of time; and making the image forming apparatus return from the energy reduction mode to the normal mode on the basis of the calculated return time.

* * * * *